US010100469B2

(12) United States Patent
Lichtberger

(10) Patent No.: US 10,100,469 B2
(45) Date of Patent: Oct. 16, 2018

(54) TAMPING ASSEMBLY FOR A TRACK TAMPING MACHINE

(71) Applicant: System 7—Railsupport GmbH, Vienna (AT)

(72) Inventor: Bernhard Lichtberger, Pregarten (AT)

(73) Assignee: HP3 Real GmbH, Vienna (AT)

( * ) Notice: Subject to any disclaimer, the term of this patent is extended or adjusted under 35 U.S.C. 154(b) by 0 days.

(21) Appl. No.: 15/336,373

(22) PCT Filed: Dec. 10, 2015

(86) PCT No.: PCT/AT2015/050311

§ 371 (c)(1),
(2) Date: Oct. 27, 2016

(87) PCT Pub. No.: WO2016/100993

PCT Pub. Date: Jun. 30, 2016

(65) Prior Publication Data

US 2017/0284033 A1 Oct. 5, 2017

(30) Foreign Application Priority Data

Dec. 22, 2014 (AT) ..... A 50933/2014

(51) Int. Cl.
*E01B 27/16* (2006.01)
*E01B 1/00* (2006.01)
*E01B 27/17* (2006.01)

(52) U.S. Cl.
CPC ..... *E01B 27/16* (2013.01); *E01B 1/001* (2013.01); *E01B 27/17* (2013.01); *E01B 2203/127* (2013.01)

(58) Field of Classification Search
CPC ..... E01B 27/14; E01B 27/16; E01B 27/17; E01B 27/18
USPC ..... 104/10, 11, 12, 13, 14
See application file for complete search history.

(56) References Cited

U.S. PATENT DOCUMENTS 3,981,247 A * 9/1976 Theurer ..... E01B 27/16 104/12
4,068,595 A * 1/1978 Weber ..... B06B 1/18 104/12

(Continued)

FOREIGN PATENT DOCUMENTS

AT 339 358 10/1977
AT 369 455 1/1983

(Continued)

OTHER PUBLICATIONS

Espacenet. English Language Abstract of DE 26 15 358. Plasser Bahaumasch Franz, Aug. 25, 1977.

(Continued)

*Primary Examiner* — Jason C Smith
(74) *Attorney, Agent, or Firm* — Tiajoloff & Kelly LLP

(57) ABSTRACT

A tamping assembly for a track tamping machine comprises a carrier guided in a height-adjustable manner with respect to a tamping assembly frame along guides, on which carrier pairs of tamping tools formed as oscillating levers are pivotably mounted, the tamping tools of which can be oppositely driven by an oscillation drive and can be hydraulically adjusted relative to one another, said tamping tools being intended for introduction into a ballast bed. To reduce the number of required drives, several of the tamping tools are combined into tamping units with a compartment between them engaging around a rail and are mechanically connected to each other, and each oscillating lever is associated with a tamping unit and an adjusting drive, wherein the guides, especially the guide rods, act directly on the respective carrier and run in fixed guides of the tamping assembly frame.

9 Claims, 5 Drawing Sheets

(56) References Cited

U.S. PATENT DOCUMENTS

| | | | | |
|---|---|---|---|---|
| 4,069,763 | A * | 1/1978 | Theurer | E01B 27/16 104/12 |
| 4,240,352 | A * | 12/1980 | Theurer | E01B 27/16 104/12 |
| 4,423,684 | A * | 1/1984 | Theurer | E01B 27/17 104/12 |
| 4,942,821 | A * | 7/1990 | Rossanigo | E01B 27/16 104/12 |
| 2006/0090666 | A1* | 5/2006 | Theurer | E01B 27/16 104/12 |
| 2010/0064928 | A1* | 3/2010 | Theurer | E01B 27/16 104/10 |
| 2011/0030573 | A1* | 2/2011 | Theurer | E01B 27/16 104/10 |
| 2016/0010287 | A1* | 1/2016 | Lichtberger | E01B 27/16 104/10 |
| 2017/0284033 | A1* | 10/2017 | Lichtberger | E01B 27/16 |

FOREIGN PATENT DOCUMENTS

| | | | |
|---|---|---|---|
| DE | 24 24 829 | A1 | 1/1976 |
| DE | 26 15 358 | A1 | 8/1977 |
| DE | 27 54 881 | A1 | 10/1978 |
| EP | 0 208 826 | A1 | 1/1987 |
| EP | 0 331 956 | A2 | 9/1989 |
| EP | 1 653 003 | A2 | 5/2006 |
| EP | 2 770 108 | A1 | 8/2014 |

OTHER PUBLICATIONS

Espacenet. English Language Abstract of EP 1 653 003. Plasser Bahnhaumasch Franz, May 3, 2006.

Espacenet. English Language Abstract of EP 2 770 108. System 7 Railsupport GmbH, Aug. 27, 2014.

Espacenet. English Language Abstract of EP 0 208 826. Plasser Bahnbaumasch Franz, Jan. 21, 1987.

* cited by examiner

TAMPING ASSEMBLY FOR A TRACK TAMPING MACHINE

FIELD OF THE INVENTION

The invention relates to a tamping assembly for a track tamping machine, comprising a carrier which is guided in a height-adjustable manner with respect to a tamping assembly frame along guides, on which carrier pairs of tamping tools formed as oscillating levers are pivotably mounted, the tamping tools of which can be oppositely driven by an oscillation drive and can be hydraulically adjusted relative to one another, said tamping tools being intended for introduction into a ballast bed, wherein each of the tamping tools of a pair of tamping tools is associated with an adjusting drive, wherein several of the tamping tools are combined into tamping units which leave a compartment between themselves for engaging around a rail and are mechanically connected to each other, and each oscillating lever is associated with a tamping unit and an adjusting drive, and the guides are preferably arranged outside of the working area of the oscillating levers (DE 2754881 A1, DE 2615358 A1).

DESCRIPTION OF THE PRIOR ART

Tamping assemblies penetrate the ballast of a ballast bed with tamping tools in the region between two track ties (intermediate compartment), in the region of the support of the track tie in the ballast beneath the rail and compact the ballast by dynamic vibration of the tamping tines between the oppositely disposed tamping tines that can be set against each other. Tamping assemblies can tamp one, two or more track ties in one working cycle (DE 24 24 829 A, EP 1 653 003 A2). According to the teachings of EP 1 653 003 A2, the adjusting drives which are active as a linear drive are formed in such a way that they not only produce a linear adjusting movement but simultaneously also produce the vibration required for the tamping tines in a manner known from AT 339 358, EP 0 331 956 or U.S. Pat. No. 4,068,595. The adjusting velocity, the vibration amplitude, its shape and frequency can thus be predetermined.

The movements of a tamping assembly include the vertical immersion of the tamping tines into the ballast, the adjusting movement in which the tamping tine ends are closed with respect to each other, and the superimposed dynamic oscillation which produces the actual compaction of the ballast grains. It is known to use hydraulic cylinders for the adjusting movement, which are connected via connecting rods to a vibration shaft with eccentricity and which superimpose the vibratory oscillation to the adjusting movement (AT 369 455 B). These vibration shafts and connecting rods are mounted via roller bearings which require regular expensive maintenance. Other known solutions use linear vibration generation and an adjusting movement via hydraulic cylinders.

The tamping assemblies that are currently used lead to a very high level of maintenance at high costs. The assemblies are typically maintained and serviced each season at least in part.

Conventional tamping assemblies comprise stationary guide columns which are arranged centrally between the rails and along which the tamping assemblies are guided up and down by means of tamping boxes. The guides are situated centrally above the rail. The vibration shafts are situated to the left and the right of the centre of the tamping box that is moved up and down, via which the tamping arms with the tamping tools are driven via adjusting cylinders which are connected via connecting rods to the eccentric shaft. Four drives are required for a single-tie tamping machine. This already means eight drives for a single-tie tamping machine with two units, sixteen drives for a double-tie tamping machine, twenty-four drives for a triple-tie tamping machine, and thirty-two drives for a quadruple-tie tamping machine. The level of investment, the amount of maintenance work and the failure probability increase with the number of the drives.

Guide columns of the guides are offset to the outside to such an extent in single-tie and double-tie units (DE 2754881 A1, DE 2615358 A1) so that the tamping drives are provided with space in the centre of the tamping assembly. This configuration is inadequate for a triple-tie or quadruple-tie tamping machine.

SUMMARY OF THE INVENTION

The invention is thus based on the object of further developing tamping assemblies of the kind mentioned above with simple means in such a way that an application of a triple-tie or quadruple-tie tamping machine is advantageously possible, wherein it is intended to make do with the lowest possible number of drives.

This object is achieved by the invention in such a way that the guides, especially the guide rods, act directly on the carrier and run in fixed guides of the tamping unit frame.

It is proposed in this case that the guides, especially the guide rods, act directly on the respective carrier (the tamping box) and are guided in fixed guides of the tamping unit frame. The guide columns are therefore connected to the tamping unit and move up and down together with the tamping unit. The guide columns are moved in a fixed guide. Instead of fixed guide columns with moved guidance in the tamping box, the guide columns connected to the tamping unit are moved in a fixed guide. This leads to the further advantage that the tamping frame, which accommodates the units and in which the guide columns are fixedly mounted, can now be provided with a smaller configuration and thus forms a guide console which accommodates and guides the tamping unit. This leads to improved accessibility to the tamping unit itself in addition to a weight reduction. This embodiment in accordance with the invention also offers the advantage that an integral tamping tool arm with a tool console for the tamping tine can be formed.

The reduction in the number of drives offers a major practical advantage. It is principally not necessary in a line tamping machine that the tamping arms situated on the inside and the outside with respect to the rail operate independently with the tamping tools and each comprise a separate drive. As a result of the mechanical connection of the tamping arms situated to the left and the right of the rail, one adjusting drive per tamping unit is already sufficient. Two tamping assemblies form an interacting pair of tamping assemblies. The number of the necessary adjusting drives can be halved by this configuration. The usual fixed guide columns which are arranged in the centre of the tamping unit hinder the arrangement of the adjusting drives at this position, which is why the guides are preferably arranged outside of the operating range of the oscillating levers. If only one tamping tool arm is provided per tamping unit, the number of the tamping tools arms and the number of their bearings that require a high level of maintenance are also halved.

The oscillating drive and the adjusting drive are preferably arranged in a central vertical plane of the carrier and the tamping units, and the adjusting drive is connected to the oscillating lever directly via a hinge pin for power transmission.

The oscillating drives are formed according to a constructively simple solution as linear drives, especially as hydraulic cylinders, and simultaneously form the adjusting drives.

Furthermore, the oscillating levers, which accommodate the tamping tools joined into tamping units, can comprise one common tool holder each, especially a carrier, for the tamping tines of a tamping unit. It is then only necessary to provide one tamping tools arm per tamping unit.

The tamping drive is advantageously selected as a fully hydraulic linear drive. A conventional tamping drive, comprising a continuous, externally mounted eccentric vibration shaft with inwardly disposed eccentricities and connecting rods acting thereon and being connected to adjusting cylinders, can principally also be provided. At least two guides are provided for each carrier (tamping box). Three or four guides can also be used for increasing the stability. The fixed guides of the tamping unit frame can guide two or more carriers (tamping boxes) for the purpose of forming a multiple tamping unit, which carriers are height-adjustable independently from each other.

The relevant advantages of the invention are the simplified construction, the halving of the necessary tamping drives, the halving of the tamping arms and the bearing in connection therewith, thus leading to lower investment costs, reduced maintenance costs, reduced failure probability, better accessibility to the tamping unit components for maintenance work, and a reduction in weight.

BRIEF DESCRIPTION OF THE DRAWINGS

The subject matter of the invention is shown in the drawings by way of example, wherein.

DESCRIPTION OF THE PREFERRED EMBODIMENT

Figure 1:
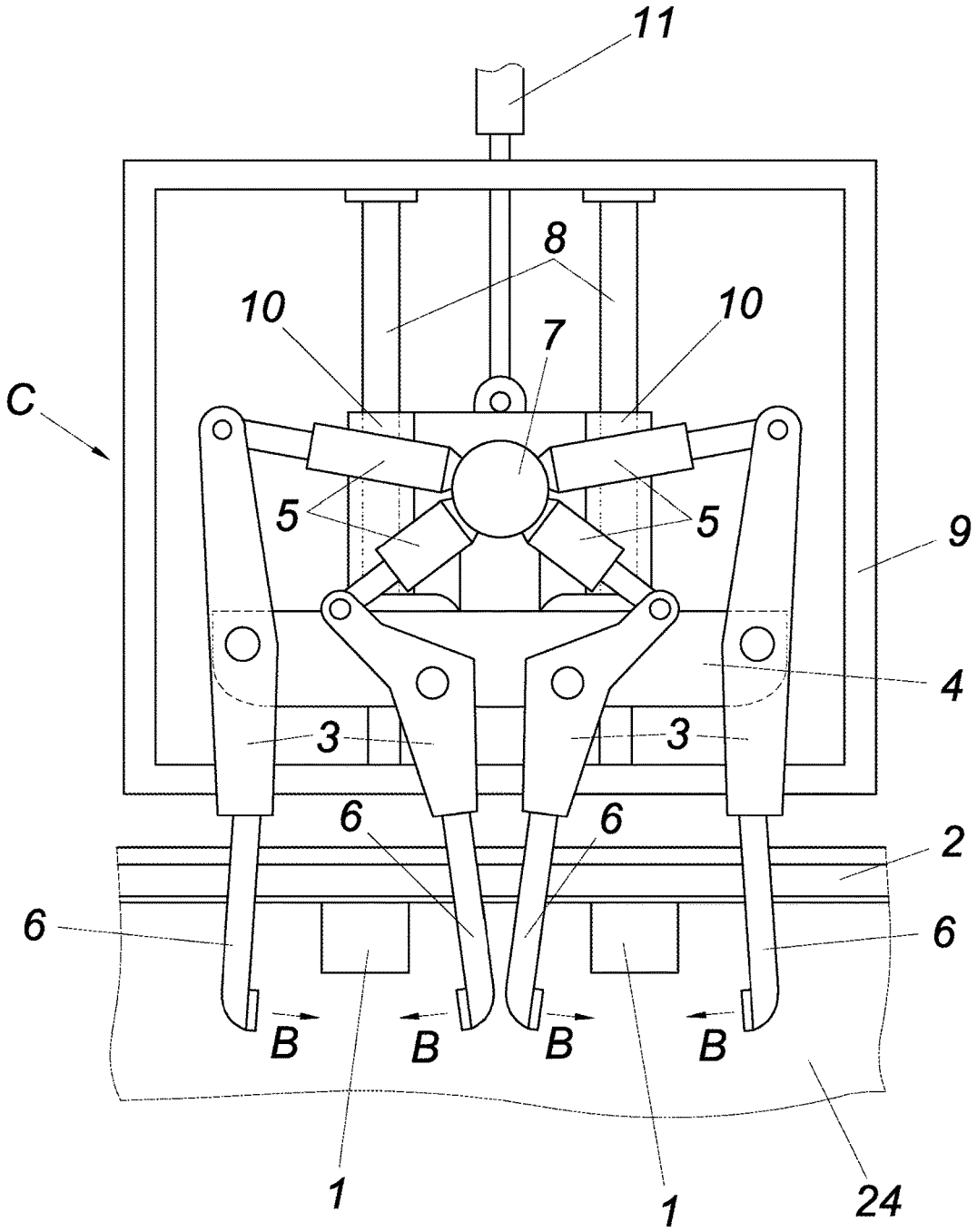
FIG.1 Prior Art
FIG. 1 shows a double-tie tamping unit according to the prior art in a side view.

In FIG. 1, which shows the prior art, a known double-tamping assembly C is schematically shown, which comprises a continuous vibration shaft, via which four adjusting drives 5 act via connecting rods on the left side of the eccentric shaft and four adjusting drives 5 act via connecting rods on the right side of the eccentric shaft C. Left and right designate the regions to the left and right of a rail of a track. A formerly conventional double-tie tamping assembly C comprises a total of eight tamping arms 3 for each rail (four each for the region to the left of the rail and four for the region to the right of the rail), eight adjusting cylinders 5, sixteen tamping tools 6 and an oscillating drive with pump 7 and a flywheel. The same effort must be provided for the second rail of the track. For this purpose, two vertical guides 8 are required in the region above the track, a lifting and lowering drive 11 and a tamping frame 9.

A tamping assembly C, D, E, F for a track tamping machine comprises among other things pairs of tamping tools 6 which are pivotably mounted on a carrier 4, 18, 23 and formed as oscillating levers 3, 19, whose tamping tine ends determined for penetrating a ballast bed 24 can be driven in opposite direction by an oscillating drive 7, 17, 20 and can be hydraulically moved towards each other by adjusting drives 5 with an adjusting path B. The carrier 4, 18, 23 is guided in a height-adjustable manner with guides 8, 15, 22 in a tamping assembly frame 9, 14, which can also be formed in the manner of a table, and can be moved by an actuator 11 to the desired height position. The tamping tools 3 are formed as two-arm levers, which are pivotably mounted on the carrier 4, 18, 23. One arm of the respective tamping tool consists of the swivel arm 3 and the tamping tine 6, and an adjusting drive 5, which is a hydraulic cylinder, acts on the other lever arm.

Figure 2:
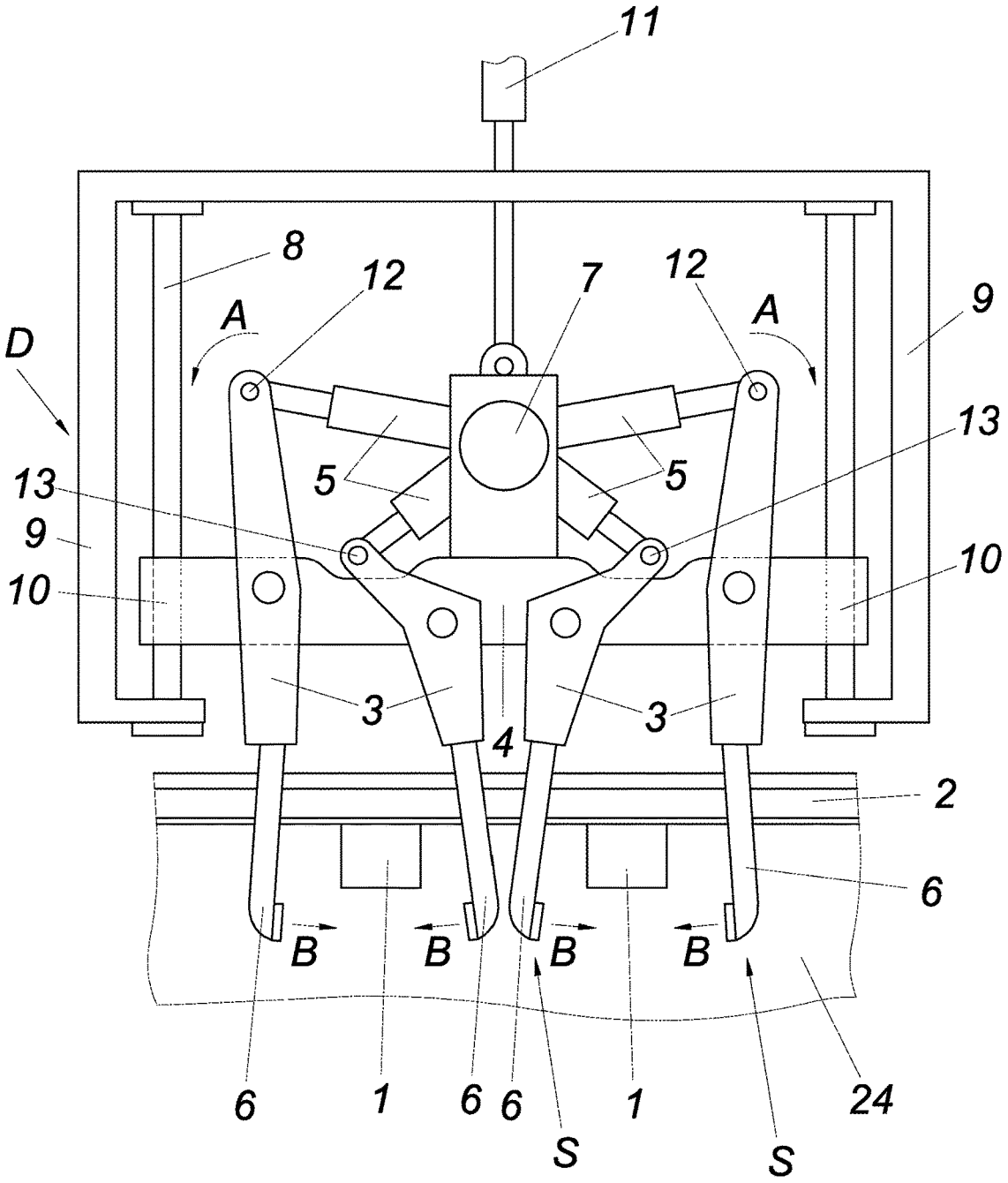
FIG. 2 shows a side view of a double-tie tamping unit in accordance with the invention with connected tamping arms and a central drive.

FIG. 2 shows an embodiment in accordance with the invention of a double-tie tamping assembly D, in which the tamping arms 3 are connected to the left and the right of the rail 2 via continuous pins 12, 13. The tamping tools 6 to the left and right of the rail 2 are combined to form tamping units S, which leave a compartment between themselves for engaging around a rail and are mechanically connected to each other. Furthermore, each oscillating lever 3, 19 is associated with a tamping unit (S), an oscillation drive 7, 17, 20 and an adjusting drive 5, and the guides 8, 15, 22 are arranged outside of the working area of the oscillating levers 3, 19.

Only one adjusting cylinder 5 each acts on the transverse pins 12, 13. In order to allow a conventional double-tie tamping assembly D to be equipped with a centrally arranged oscillating drive 7, the vertical guides 8 must be moved to the outside. The connecting rods, which are connected to the adjusting cylinders 5, then act in the region of the centre of the vibration shaft. As a result, a conventional single-tie or double-tide tamping assembly D makes do with only four adjusting cylinders 5, instead of the eight cylinders provided according to the prior art. The oscillating drive 7, 17 and 20 and the adjusting drive 5 are arranged in a central vertical plane of the carrier 4, 18, 23 and the tamping units S, and the adjusting drive 5 is connected to the oscillating lever 3, 19 for power transmission directly via a hinge pin 12, 13. The unit D is lifted or lowered via a lifting and lowering drive 11. The carrier arm 4 must be exempt in the region of the inner tamping drives 5 so that the pin 13 that transversely connects the tamping arms 3 does not collide with the carrier arm. The carrier arm 4 runs externally via guides 10 on the guide columns 8. The guide columns 8 are offset to the outside to such an extent that the outer tamping arms 3 do not collide with said columns during the adjustment B.

Figure 3:
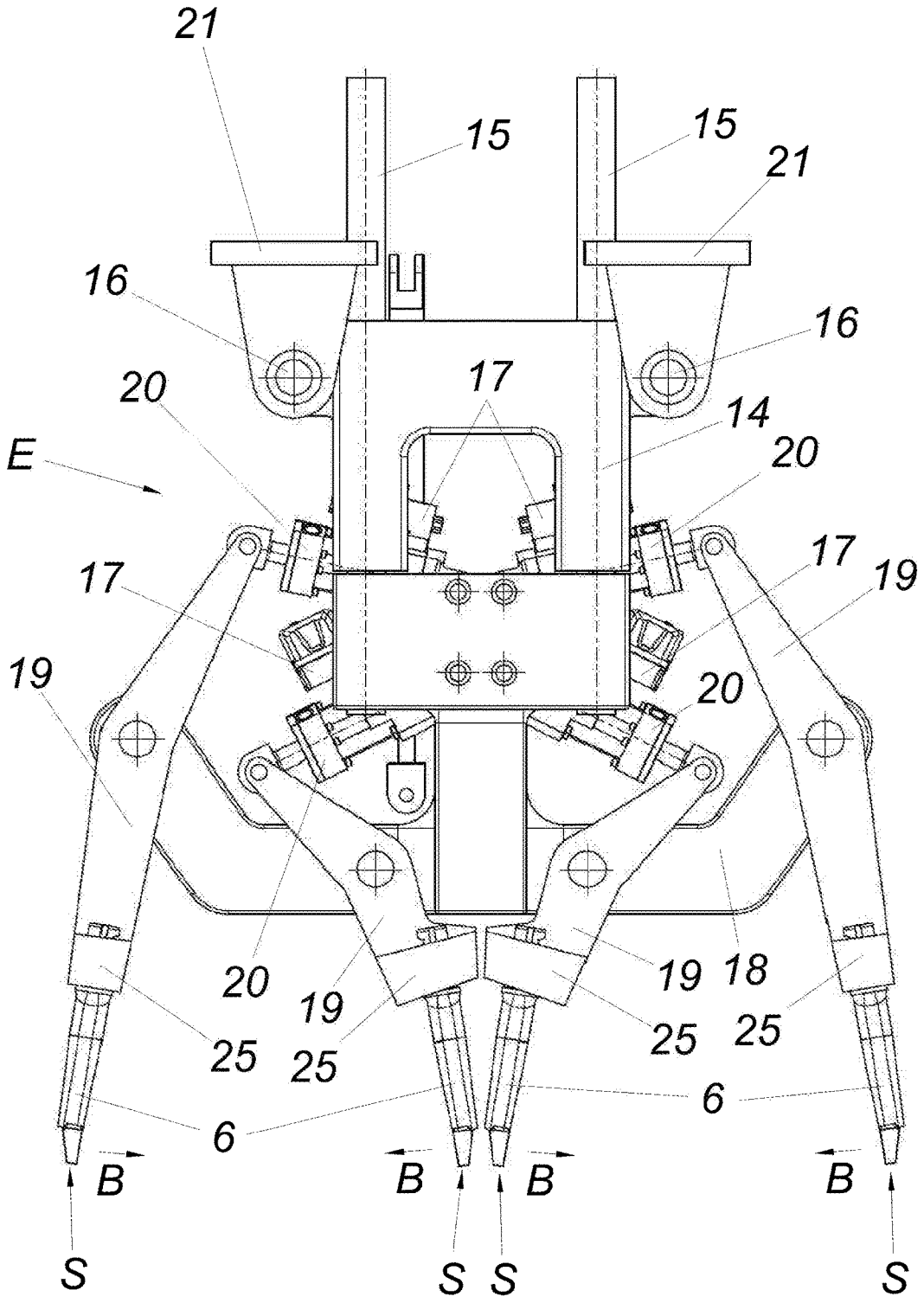
FIG. 3 shows a variant of a double-tie tamping assembly in accordance with the invention in a side view with moved guide columns and fixed guide with four linearly acting tamping drives and only four tamping arms and tool consoles for the tamping tines in a side view.

FIG. 3 shows the embodiment in accordance with the invention of a double-tie tamping assembly E with only four tamping arms 19, four adjusting cylinders 20, and the guide columns 15 which are fixedly connected to the tamping assembly carrier 18 and which run in guides 14 which are rigidly fixed to the machine frame of a track tamping machine (not shown in closer detail). In order to compensate deflections in the curved track, the tamping assemblies E are moved themselves on transverse guides 16. The vibration is superimposed in the illustrated embodiment in the hydraulic cylinders 20 by means of proportional valves 17 of the adjusting movement B. The oscillating levers 19 are formed integrally with a tool holder 25 for the tamping tines 6. The guides 15, especially the guide rods, act directly on the respective carrier 18, pass through the tamping assembly frame 9, 14, and run in fixed guides of the tamping assembly frame 9, 14. The oscillating drives 7, 17, 20 are formed as linear drives, especially as hydraulic cylinders, and can simultaneously form the adjusting drives 5.

Figure 4:
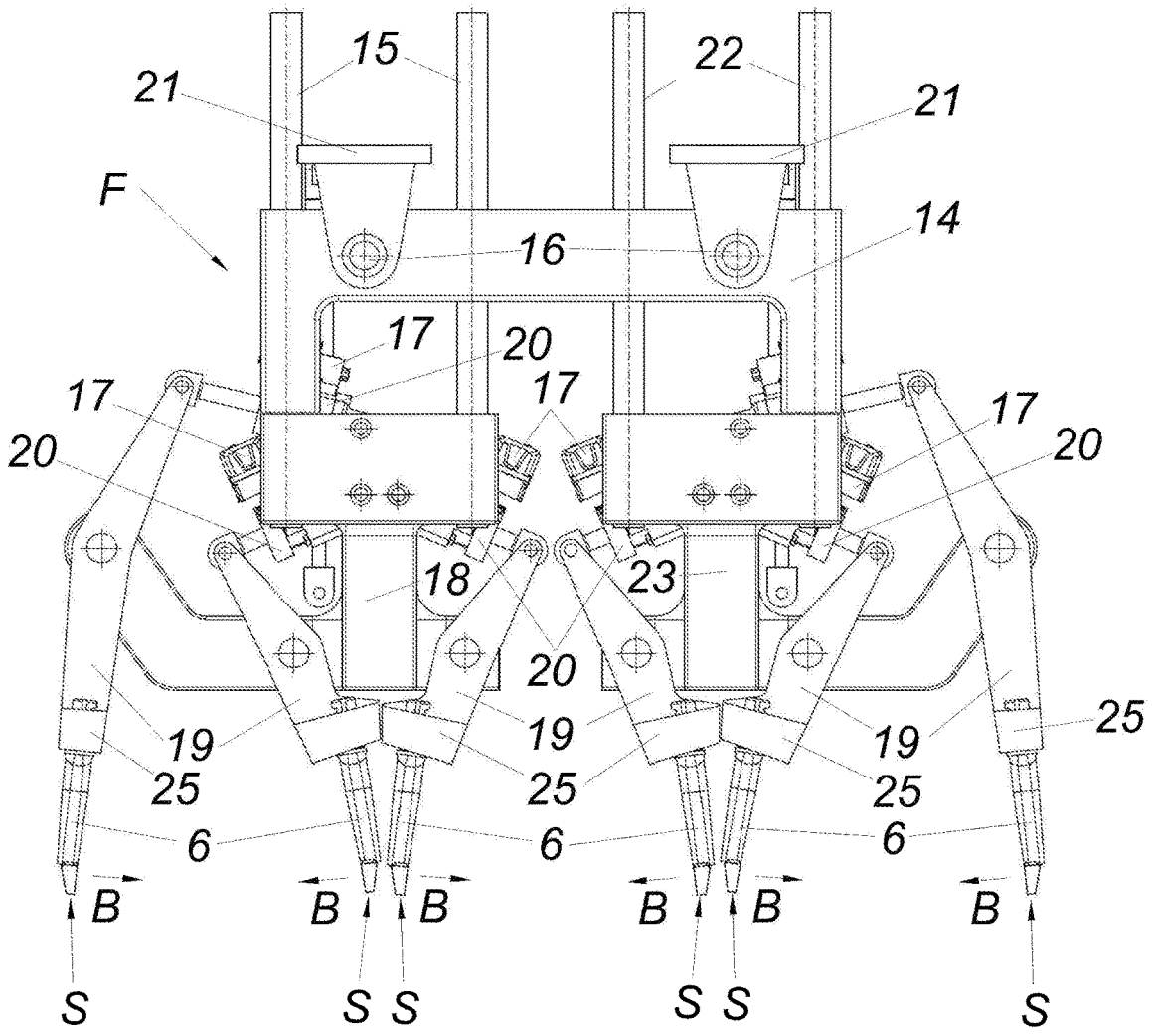
FIG. 4 shows a triple-tie tamping assembly in a side view.
Figure 5:
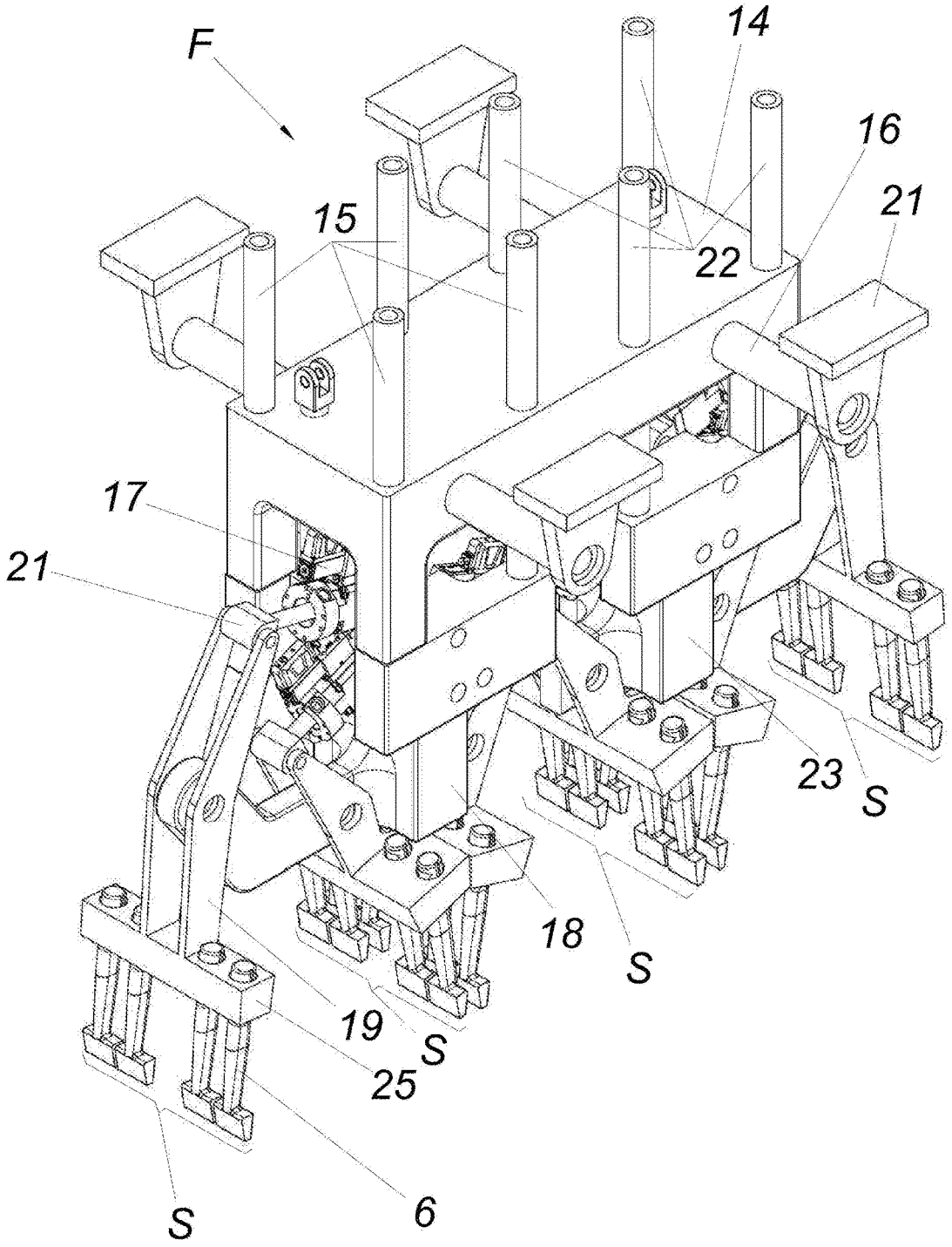
FIG. 5 shows the triple-tie tamping assembly of FIG. 4 with guide columns and associated fixed guide with six linearly acting tamping drives and six tamping arms in a perspective oblique view.

A triple-tie tamping assembly F in accordance with the invention (FIGS. 4 and 5) consists of two carriers 18, 23 which can be moved independently up and down. As a result, the triple-tie tamping assembly F can also be used as a single-type unit in the case of irregular division of the track ties. In this case, only a partial unit 18 or 23 is lowered. The innermost oscillating lever 19, which is directly adjacent to the other partial unit, can remain in a non-actuated state in the single-tie mode. Each tamping assembly has its own guides 15, 22 which run in a common guide console for example of the tamping assembly frame 14. It is understood that said guide console can principally also be formed in a separate manner for each unit. In order to compensate deflections in the curved track, the tamping assemblies F are moved on transverse guides 16. The vibration is superimposed on the adjusting movement B in the illustrated embodiment in the hydraulic cylinders 20 by means of proportional valves 17. The configuration of a triple-tie tamping assembly F in accordance with the invention is shown in FIG. 5 in a perspective view.

The invention claimed is:

1. A track tamping machine having a tamping assembly comprising:

a tamping assembly frame;

guides supported on the tamping assembly frame;

a carrier guided on the guides in adjusting vertical movement with respect to the tamping assembly frame;

oscillating levers pivotably mounted on said carrier;

each of said oscillating levers having a tamping unit thereon comprising a number of tamping tools on the oscillating lever, said tamping tools being configured to be introduced into a ballast bed;

each of said tamping tools being supported on the associated oscillating lever so as to form a pair of tamping tools with a respective other of the tamping tools on another of the oscillating levers;

an oscillation drive connected with and driving said oscillating levers so as to oscillate the tamping tools thereon opposingly to the other of the tamping tools of the associated pair of tamping tools;

the oscillating levers each being connected with a respective adjusting drive that provides hydraulically adjusting movement of the tamping tools thereon relative to the other tamping tools of the associated pairs of tamping tools;

wherein in each tamping unit, the respective tamping tools are mechanically connected to each other and define a compartment therebetween receiving therein a rail; and wherein the tamping assembly frame has fixed guide structures, and the guides comprise guide rods that act directly on the carrier and run in the fixed guide structures.

2. A track tamping machine according to claim 1, wherein the oscillating drive and the adjusting drives are arranged in a central vertical plane of the carrier and the tamping units, and the adjusting drives are each is connected to the respective oscillating lever directly via a hinge pin through which power is transmitted.

3. A track tamping machine according to claim 1, wherein the oscillating drives are in the form of linear drives.

4. A track tamping machine according to claim 3, wherein the oscillating drives also constitute the adjusting drives.

5. A track tamping machine according to claim 1, wherein the oscillating levers, which are joined into the tamping units and accommodate the tamping tools, each comprise a respective tool holder holding tamping tines of a tamping unit.

6. A track tamping machine according to claim 1, wherein at least two guides are provided for the carrier.

7. A track tamping machine according to claim 1 wherein the fixed guides of the tamping assembly frame guide one or more additional carriers independently from the carrier and from so as to form a multiple tamping assembly.

8. A tamping assembly according to claim 1, wherein the guides are arranged outside of the working area of the oscillating levers.

9. A tamping assembly according to claim 3 wherein the linear drives are hydraulic cylinders.

* * * * *